United States Patent [19]

Jezek

[11] 4,248,296

[45] Feb. 3, 1981

[54] FLUID DISTRIBUTOR FOR CONDENSER TUBES

[75] Inventor: Louis J. Jezek, Federal Way, Wash.

[73] Assignee: Resources Conservation Company, Seattle, Wash.

[21] Appl. No.: 64,590

[22] Filed: Aug. 7, 1979

[51] Int. Cl.[3] ..... F28D 3/04; F28F 9/02; F28F 25/02

[52] U.S. Cl. ..... 165/118; 239/468; 239/487; 239/492

[58] Field of Search ..... 165/118, 174, 115; 366/165; 239/468, 487, 492

[56] References Cited

U.S. PATENT DOCUMENTS

| | | | |
|---|---|---|---|
| 975,321 | 11/1910 | Borgeson | 239/468 |
| 1,184,936 | 5/1916 | Falkenwalde | 138/38 |
| 1,452,264 | 4/1923 | Binks | 239/492 |
| 1,678,932 | 7/1928 | Bühler | 239/468 |
| 1,693,629 | 12/1928 | Webre | 239/468 |
| 1,694,370 | 12/1928 | Burdick | 165/118 |
| 2,218,110 | 10/1940 | Hosmer et al. | 239/468 |
| 2,247,897 | 7/1941 | Wahlin | 239/468 |
| 2,386,122 | 10/1945 | Klingen | 239/468 |
| 2,414,442 | 1/1947 | Breault | 239/468 |
| 2,498,752 | 2/1950 | Copeland | 165/118 |
| 2,577,574 | 12/1951 | Freer | 165/118 |
| 2,644,720 | 7/1953 | Carr | 239/468 |
| 2,969,009 | 1/1961 | Caldwell | 239/468 |
| 3,001,726 | 9/1961 | Hasbrouck | 239/468 |
| 3,016,067 | 1/1962 | Edmonds | 165/118 |
| 3,027,143 | 3/1962 | Furgerson et al. | 165/174 |
| 3,153,429 | 10/1964 | Palm | 138/38 |
| 3,175,771 | 3/1965 | Breting | 239/468 |
| 3,326,473 | 6/1967 | Wahlin | 239/468 |
| 3,339,631 | 9/1967 | McGurty et al. | 165/109 T |
| 3,437,124 | 4/1969 | Bryan et al. | 165/118 |
| 3,519,209 | 7/1970 | Limoni | 239/468 |
| 3,920,187 | 11/1975 | Willis | 239/487 |
| 3,995,663 | 12/1976 | Perry | 165/118 |
| 4,032,114 | 6/1977 | Kolm et al. | 366/165 |

FOREIGN PATENT DOCUMENTS

| | | | |
|---|---|---|---|
| 1079141 | 11/1954 | France | 165/174 |
| 225352 | 4/1943 | Switzerland | 165/118 |
| 764 | of 1856 | United Kingdom | 165/174 |
| 1482744 | 8/1977 | United Kingdom | 165/174 |

*Primary Examiner*—Sheldon Richter
*Attorney, Agent, or Firm*—Bacon & Thomas

[57] ABSTRACT

A fluid distributor for mounting in the upper end of a vertical condenser tube, comprising a ferrule having a downwardly opening cavity therein, the cavity including a lower frusto-conical portion and an upper spherical portion which is tangential to said lower portion. The ferrule has an enlarged head portion containing at least one inlet orifice, the orifice extending upwardly at an angle from a horizontal plane passing through the upper end of the ferrule chamber, and the inner end thereof opening tangentially on the wall defining the spherical chamber portion. Fluid entering the ferrule chamber through the inlet orifice is directed thereby both laterally and downwardly, to establish an inverted vortex from which is formed a uniform hollow cylindrical film of fluid.

8 Claims, 3 Drawing Figures

FLUID DISTRIBUTOR FOR CONDENSER TUBES

TECHNICAL FIELD OF THE INVENTION

This invention relates generally to a fluid distributor for use in the upper end of a vertical condenser tube in a falling film type heat exchanger, or similar equipment, to form a uniform hollow cylindrical film of falling fluid on the interior surface of the condenser tube. More particularly, it relates to an improved fluid distributor which is clog-free in operation, and which will assure complete wetting of the condenser tube's interior surface.

BACKGROUND OF THE INVENTION

Vertical falling film type heat exchangers and like equipment have long been in use. In such equipment, a plurality of vertically disposed condenser tubes is mounted between upper and lower headers. Fluid is introduced into the condenser tubes from their upper ends, and a distributor device is utilized in each condenser tube to distribute the fluid and help it form a falling film on the interior surface of the tube. The fluid film then falls downwardly on the condenser tube interior surface into a fluid collection area beneath the lower header.

There can be many hundreds of condenser tubes in a typical heat exchanger or the like, and all of the tubes must be fitted with a fluid distributor device. Typically, the condenser tubes will be mounted so that the upper ends thereof all open into an upper header which contains a body of fluid, the fluid being allowed to flow by gravity into the tubes.

In certain types of equipment, the quality of the hollow cylindrical fluid film on the interior surfaces of the vertical condenser tubes is not too critical. However, in other instances it is necessary that the condenser tube interior surfaces be completely and evenly wetted at all times. For example, in a standard brine concentrator, which may contain 1800 or more vertical condenser tubes into which a brine slurry flows to form the falling fluid film, it is necessary that all portions of the tube interior surfaces be completely and continuously wetted. Otherwise, scale can form on the tube interior surfaces, and can accumulate until the condenser tubes become blocked and the heat exchanger is rendered inoperable.

A number of fluid distributor devices has been proposed over the years, which for purposes of this discussion can be divided into two general types. One type is shown in U.S. Pat. No. 3,995,663, wherein a tapered or other suitably shaped fluid distributing member is centrally mounted by one or more struts within the bore of a distributor body. While this type of distributor can produce effective results, the distributing member and its supporting struts tend to abrade during usage, especially when the operating fluid is a brine slurry or the like. Further, the distributing member and its supporting struts tend to capture any foreign matter in the fluid, which can cause blockage of the fluid flow and the formation of an incomplete falling film.

In the second general type of distributor device, to which this invention relates, the distributor member and its supporting struts are eliminated. Instead, the fluid is introduced tangentially into a chamber in the distributor body to form a swirling vortex, and the vortex places a rotating, hollow cylindrical film of fluid on the interior surface of the condenser tube. An example of a fluid distributor device of this type is shown in U.S. Pat. No. 3,016,067.

The device of U.S. Pat. No. 3,016,067 shows, in FIGS. 3 and 4, a distributor having an open frustoconical chamber with a flat top wall. Fluid is introduced into the upper end of this chamber through horizontally disposed passageways, arranged tangentially to the frusto-conical chamber wall. Fluid entering the chamber swirls about to establish a vortex, and forms a rotating, uniform hollow cylindrical fluid film on the interior surface of a vertical condenser tube connected with the distributor. The present invention is an improvement on the distributor of U.S. Pat. No. 3,016,067 and produces a most even wetting of the condenser tube's interior surface.

BRIEF SUMMARY OF THE INVENTION

In the present invention, the improved fluid distributor includes a ferrule mounted in the upper end of a condenser tube, the ferrule having a completely open chamber extending upwardly thereinto from its lower end. The condenser tube is mounted to extend vertically between upper and lower headers, in the usual manner. The ferrule chamber includes a frusto-conical lower portion, generally similar in shape to the chamber of U.S. Pat. No. 3,016,067. However, the overall configuration of the chamber and the arrangement of the inlet orifices in the present invention differ substantially from anything known in the prior art, and such features produce a significantly improved performance over the device of prior U.S. Pat. No. 3,016,067.

In addition to the lower frusto-conical portion just mentioned, the ferrule chamber of the present invention also includes a spherically shaped upper portion, arranged tangentially to the frusto-conical lower chamber portion. At least one inlet orifice is provided in the head portion of the ferrule, and such is inclined upwardly from a horizontal plane passing through the upper portion of the ferrule chamber. The inlet orifice opens tangentially into the upper spherically shaped portion of the chamber, and serves to admit fluid to the chamber from the upper header.

The included inlet orifice of the invention directs the fluid inwardly and downwardly into the ferrule chamber, where it impacts against the spherical upper chamber portion and the upper portion of the frusto-conical lower chamber portion. The swirling fluid establishes an inverted vortex, and a substantially perfectly formed rotating, hollow cylindrical film of fluid is produced that flows smoothly down into the interior surface of the condenser tube.

It has been found that the angle of inclination of the inlet orifice has critical limits, as does the angle of inclination from the vertical of the frusto-conical wall defining the lower chamber portion. By utilizing the unique chamber configuration and staying within the critical angle limits of the present invention, a fluid distributor is provided which is clearly superior in performance to any heretofore known distributor device.

It is the principal object of the present invention to provide an improved fluid distributor device for use in vertical condenser tubes and the like, arranged to continuously produce an optimum rotating, hollow cylindrical film of fluid on the interior surface of a condenser tube.

Another object is to provide an improved fluid distributor which is clog-free in operation, even when utilizing brine liquids and liquids having abrasive qualities or which carry some foreign matter.

A further object is to provide an improved fluid distributor which can be economically produced in quantity, and which can be easily installed in equipment having large numbers of vertical condenser tubes or the like.

Other objects and many of the attendant advantages of the present invention will become readily apparent from the following description of the preferred embodiment when taken in connection with the attached drawings.

DETAILED DESCRIPTION OF THE PREFERRED EMBODIMENT

Figure 1:
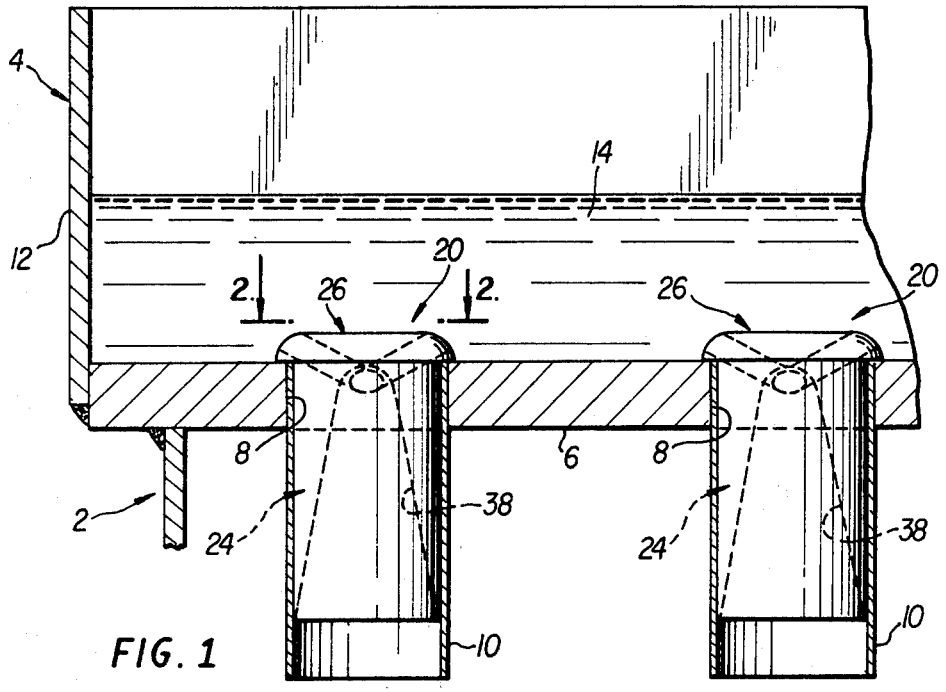
FIG. 1 is a fragmentary vertical sectional view through the upper header of a heat exchanger having a plurality of vertical condenser tubes, and shows fluid distributors constructed according to the present invention mounted within the upper end of the condenser tubes.

Referring now to the drawings, a falling film type heat exchanger is indicated generally at 2, and includes an upper header 4 having a mounting plate 6 provided with a plurality of bores 8, the upper end of a condenser tube 10 being received and secured within each of the bores 8. The lower ends of the condenser tubes 10 are mounted in bores provided in a lower header (not shown), in the usual manner. The upper header 4 includes a sidewall enclosure 12, and receives a body of fluid 14 which is intended to flow vertically downwardly through the condenser tubes 10 under the force of gravity. Structure of this kind is widely known in the art, and hence no further description thereof is believed necessary.

Received within the upper end of each of the condenser tubes 10 is an improved fluid distributor device 20, constructed according to the invention. The distributor devices 20 are all identical, and each comprises a ferrule 22 having a lower portion 24 and an enlarged head portion 26, the exterior of the lower ferrule portion 24 having a cylindrical configuration and being sized to be received within the upper end of a condenser tube 10. The enlarged ferrule head portion 26 includes a circular flange 28 having a flat undersurface 30 which is engaged with the top surface of the mounting plate 6, and a flat upper surface 32. The top peripheral edge 34 of the flange 28 is radiused, the radius extending downwardly from the flange top surface 32 for about one-half or more of the flange's thickness.

The interior of the ferrule 22 has a completely open chamber 36 extending upwardly therein, from its lower end. The chamber 36 includes a frusto-conical lower portion defined by a frusto-conical wall 38, the diameter of the lower end of which is about the same as the external diameter of the lower ferrule portion 24 so as to form an edge 40 which merges smoothly into the interior cylindrical surface 42 of the mating condenser tube 10.

The chamber 36 also includes a spherically shaped upper portion defined by a spherical wall 44, which is tangential to the upper end of the frusto-conical wall 38 so that there is a completely smooth and uninterrupted transition therebetween. The combination of the spherical dome and the frusto-conical lower portion to form the ferrule chamber 36 is an important feature of the invention. The resultant unique chamber configuration helps assure the formation of a substantially perfectly formed hollow cylindrical fluid film on the inner condenser tube surface. Further, because the entire wall surface of the ferrule chamber 36 is smooth and uninterrupted, there are no corners or other irregularities which might serve to allow deposits of foreign material to occur and accumulate. This helps to make the distributor of the invention clog-free.

Figure 2:
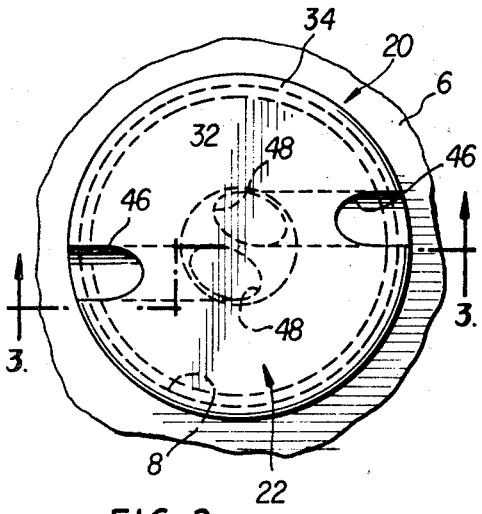
FIG. 2 is an enlarged fragmentary plan view of the fluid distributor of the invention, taken on the line 2—2 of FIG. 1.
Figure 3:
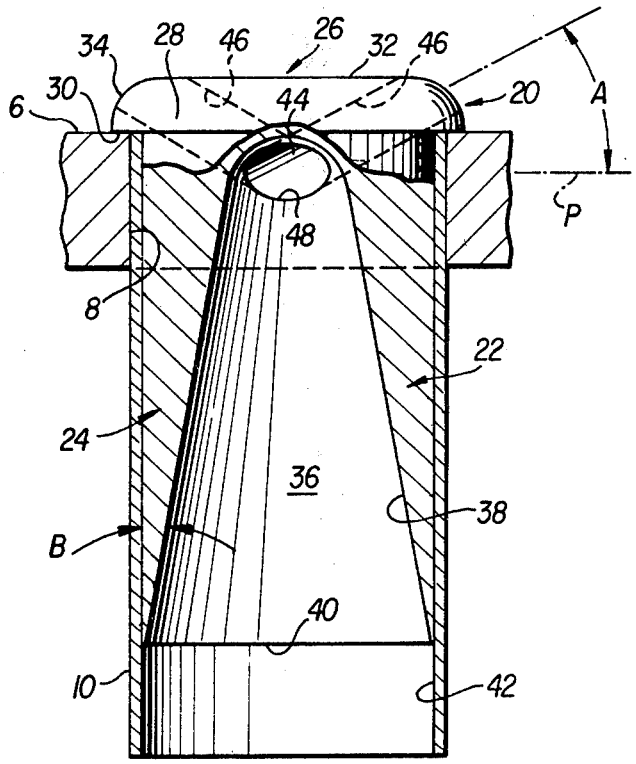
FIG. 3 is a fragmentary vertical sectional view, taken on the staggered section line 3—3 of FIG. 2.

The enlarged head portion 26 of the ferrule 22 has a pair of inlet orifices 46 therein, both inclined at an angle A to a horizontal plane P passing through the upper end of the ferrule chamber 36 perpendicular to the vertical central axis thereof. The outer end of each orifice 46 opens on the radiused upper edge 34 of the flange 28, and the inner end 48 of each orifice opens tangentially on the spherical surface 44. As best shown in FIG. 2, the outer ends of the two inlet orifices 46 open on opposite sides of the ferrule head portion 26, and the longitudinal axes of the orifices extend parallel to each other. The number of inlet orifices can be varied, from at least one to several. However, it has been found that two inlet orifices 46 arranged oppositely as shown in the drawings provide good results.

The inlet orifices 46 accept the fluid 14 under gravity flow from the upper header 4, and direct it both laterally and downwardly into the ferrule chamber 36, where it impacts against the spherical surface 44 and the upper end of the frusto-conical surface 38. Because the fluid flow is tangential and directed generally downwardly, the fluid swirls and establishes an inverted vortex within the ferrule chamber 36, which vortex will have a configuration generally conforming to the shape of the upper end of the chamber. It has been found that the downward inclination of the inlet orifices 46 helps to insure a continuous, well formed fluid vortex, and a resulting continuous, well formed rotating, hollow cylindrical film of fluid which attaches to the internal tube surface 42 and thereafter flows evenly and continuously down the condenser tube. Thorough and complete wetting of the tube surface 42 is obtained with the arrangement of the invention, and the fluid distributor 20 has been found to operate effectively without clogging, even when using abrasive fluids and fluids with some foreign matter therein.

Typically, the condenser tubes 10 will have an internal diameter of from about 1 inch to about 2 inches. Assuming an internal tube diameter of about 2 inches, then the ferrule lower portion 24 may have a length of about 3⅛ inches, and the inlet orifices 46 can have an internal diameter of about 0.438 inches. These dimensions can be varied to suit the needs of a particular installation.

It has been found that there are critical limits to the angle of inclination A of the inlet orifices 46, and to the angle of inclination from the vertical B of the frusto-conical wall 38 of the ferrule chamber 36, which if exceeded can adversely affect the performance of the fluid distributor 20. Specifically, as to the angle A, it has been found that such should not exceed about 30 degrees from the horizontal. If the angle of inclination A of the inlet orifices 46 exceeds this value, then the axial component of the stream of fluid entering the ferrule chamber 36 will begin to dominate the horizontal component, with the result that the fluid will move downwardly before an adequate rotational pattern is established in the vortex. The resultant fluid film shell may then be uneven and broken, and can become turbulent, all of which are undesirable. Centrifugal action in the fluid increases as the angle A is decreased below 30 degrees, and the spherical surface 44 readily accommodates different values for the angle A.

Turning now to the angle of inclination from the vertical B, it has been found that this angle should not exceed about 10½ degrees. If the angle B exceeds this value, the rotating fluid within the ferrule chamber 36 may not attach completely to the frusto-conical surface 38 and the cylindrical inner condenser tube surface 42. This can in turn cause areas on the inner condenser tube surface 42 which are not fully and continuously wetted, which can create problems in the condenser tube. As the value of the angle B falls below about 10½ degrees, attachment of the rotating, hollow cylindrical film of fluid improves. But usually, the inner diameter of the condenser tube 10 will impose a limitation on how lengthy the ferrule body 24 can become and still accommodate the chamber 36, with its spherical dome and the tangential, inclined inlet orifices 46.

As has been noted, the fluid distributor 20 of the invention assures the formation of an essentially uniform and perfect hollow cylindrical film of fluid in the condenser tube 10. It thus is ideally suited for use in those instances when the fluid employed is corrosive, as in a brine condenser or the like, when it is essential to keep the entire inner surface of the tube wetted at all times. The invention is especially useful for use with so-called seed slurries, and can also have particular application to high viscosity liquors such as are encountered in green/black liquor evaporators in pulp mills.

Obviously, variations and modifications of the invention are possible.

I claim:

1. A fluid distributor for use in the upper end of a vertical condenser tube in a falling film type heat exchanger or the like, for forming a hollow cylindrical film of fluid on the interior surface of said condenser tube, said fluid distributor comprising:

a ferrule, said ferrule including a lower portion having a cylindrical exterior and sized to be received within the upper end of a vertical condenser tube, and an enlarged head portion on the upper end of said lower portion;

the interior of said ferrule having a completely open chamber extending upwardly from the lower end thereof, said chamber including a frusto-conical lower portion defined by a frusto-conical wall and having a diameter at the lower end thereof about the same as the exterior diameter of said ferrule lower portion, and a spherically shaped upper portion defined by a spherical wall and arranged concentrically of the vertical axis of said chamber, said spherical wall being tangent to the upper end of said frusto-conical wall; and said enlarged ferrule head portion having at least one inlet orifice therein, the axis of said inlet orifice being inclined upwardly from a horizontal plane passing through the upper end of said chamber, and the inner end of said inlet orifice opening tangentially onto said spherical wall defining said spherically shaped upper chamber portion, whereby fluid entering said ferrule chamber through said inlet orifice is directed both laterally and downwardly against said chamber walls and swirls within the upper end of said chamber to establish an inverted vortex, and to form a rotating, uniform hollow cylindrical film of fluid which flows evenly and without interruption downwardly on the interior surface of said condenser tube.

2. A fluid distributor as recited in claim 1, wherein said inlet orifice is inclined upwardly from said horizontal plane at an angle of not greater than about 30 degrees.

3. A fluid distributor as recited in claim 1, wherein said frusto-conical wall of said ferrule chamber is inclined inwardly from the vertical at an angle of not greater than about 10½ degrees.

4. A fluid distributor as recited in claim 1, including at least two inlet orifices, said two orifices having outer ends that open on opposite sides of said enlarged ferrule head portion, the axes of said orifices extending generally parallel to each other, and both of said orifices being inclined at substantially the same angle to said horizontal plane.

5. A fluid distributor for use in the upper end of a vertical condenser tube in a falling film type heat exchanger or the like, for forming a hollow cylindrical film of fluid on the interior surface of said condenser tube, said fluid distributor comprising:

a ferrule, said ferrule including a lower portion having a cylindrical exterior and sized to be received within the upper end of a vertical condenser tube, and an enlarged head portion on the upper end of said lower portion;

the interior of said ferrule having a completely open chamber extending upwardly from the lower end thereof, said chamber including a frusto-conical lower portion defined by a frusto-conical wall that is inclined inwardly from the vertical at an angle not greater than about 10½ degrees, and a spherically shaped upper portion defined by a spherical wall and arranged concentrically of the vertical axis of said chamber, said spherical wall being tangent to the upper end of said frusto-conical wall;

said enlarged ferrule head portion having at least one inlet orifice therein, the axis of said inlet orifice being inclined upwardly from a horizontal plane passing through the upper end of said chamber at an angle of not greater than about 30 degrees, and the inner end of said inlet orifice opening tangentially onto said spherical wall defining said spherically shaped upper chamber portion, whereby fluid entering said ferrule chamber through said inlet orifice is directed both laterally and downwardly against said chamber walls and swirls within the upper end of said chamber to establish an inverted vortex, and to form a rotating uniform hollow cylindrical film of fluid which flows evenly and without interruption downwardly on the interior surface of said condenser tube.

6. A fluid distributor as recited in claim 5, wherein the diameter of the lower end of said frusto-conical portion of said ferrule chamber is about the same as the external diameter of said ferrule lower portion.

7. A fluid distributor as recited in claim 5, including at least two inlet orifices, said two orifices having outer ends that open on opposite sides of said enlarged ferrule head portion, the axes of said orifices extending generally parallel to each other.

8. A fluid distributor as recited in claim 7, wherein said enlarged head portion includes a flange having a flat undersurface, and a radiused upper periphery said outer ends of said orifices opening on said radiused flange periphery.

* * * * *